US010160592B2

(12) United States Patent
Sugawara et al.

(10) Patent No.: US 10,160,592 B2
(45) Date of Patent: Dec. 25, 2018

(54) TWO-LIQUID DISCHARGE CONTAINER

(71) Applicant: DAIZO Corporation, Osaka-shi, Osaka (JP)

(72) Inventors: Shinya Sugawara, Kyoto (JP); Kimio Kataoka, Kyoto (JP); Satoshi Mekata, Osaka (JP)

(73) Assignee: DAIZO CORPORATION, Osaka-Shi, Osaka (JP)

( * ) Notice: Subject to any disclaimer, the term of this patent is extended or adjusted under 35 U.S.C. 154(b) by 195 days.

(21) Appl. No.: 14/899,161

(22) PCT Filed: Jun. 17, 2014

(86) PCT No.: PCT/JP2014/066002
§ 371 (c)(1),
(2) Date: Dec. 17, 2015

(87) PCT Pub. No.: WO2014/203884
PCT Pub. Date: Dec. 24, 2014

(65) Prior Publication Data

US 2016/0137394 A1 May 19, 2016

(30) Foreign Application Priority Data

Jun. 18, 2013 (JP) ..... 2013-128025
Sep. 27, 2013 (JP) ..... 2013-202751
Feb. 13, 2014 (JP) ..... 2014-025974

(51) Int. Cl.
*B65D 83/66* (2006.01)
*B65D 83/62* (2006.01)
(Continued)

(52) U.S. Cl.
CPC ..... *B65D 83/66* (2013.01); *B65D 83/38* (2013.01); *B65D 83/62* (2013.01); *B65D 83/68* (2013.01);
(Continued)

(58) Field of Classification Search
CPC ..... B65D 83/66; B65D 83/38; B65D 83/62; B65D 83/68; B65D 83/682; B65D 83/44; B65D 83/36; B65D 83/384
(Continued)

(56) References Cited

U.S. PATENT DOCUMENTS 3,278,086 A * 10/1966 Clouzeau ..... B29C 49/20 222/135
3,685,696 A * 8/1972 Marraffino ..... B65D 83/20 222/136
(Continued)

FOREIGN PATENT DOCUMENTS

GB 1007401 A 10/1965
JP 4716981 B1 5/1972
(Continued)

*Primary Examiner* — Paul R Durand
*Assistant Examiner* — Andrew P Bainbridge
(74) *Attorney, Agent, or Firm* — Browdy and Neimark, PLLC

(57) ABSTRACT

A two-liquid discharge container including a container body produced from synthetic resin, a partition wall member which vertically partitions the interior of the container body into a plurality of storage parts, and a valve which is provided with discharge passages that cause the respective storage parts to communicate with the outside, and which seals the container body, wherein contents are filled into the respective storage parts, at least one of the contents is a liquefied gas, and a liquefied gas lies between an undiluted solution filled into the lower storage part and a partition wall part.

7 Claims, 12 Drawing Sheets

(51) Int. Cl.
*B65D 83/68* (2006.01)
*B65D 83/38* (2006.01)
*B65D 83/44* (2006.01)

(52) U.S. Cl.
CPC ..... *B65D 83/682* (2013.01); *B65D 83/384* (2013.01); *B65D 83/44* (2013.01)

(58) Field of Classification Search
USPC ..... 222/135, 145.5, 129, 399, 382, 386.5
See application file for complete search history.

(56) References Cited

U.S. PATENT DOCUMENTS 5,339,990 A * 8/1994 Wilder ..... B05B 11/3001 222/135
6,520,377 B2 * 2/2003 Yquel ..... B65D 83/34 222/1
7,455,195 B2 11/2008 Mekata
2006/0054634 A1 * 3/2006 Mekata ..... B05B 11/3081 222/94
2008/0083348 A1 * 4/2008 Kuo ..... A61C 9/0026 106/35
2013/0270295 A1 * 10/2013 Collias ..... B65D 1/40 222/95
2013/0284759 A1 * 10/2013 Teramoto ..... B65D 83/384 222/94
2015/0166253 A1 * 6/2015 Nomura ..... B65B 31/003 222/402.1
2016/0137394 A1 * 5/2016 Sugawara ..... B65D 83/62 222/402.1

FOREIGN PATENT DOCUMENTS

JP 2004115372 A 4/2004
JP 2004322030 A 11/2004
JP 4286154 B2 6/2009
JP 2010149164 A 7/2010
JP 2012224376 A 11/2012
WO 2003091128 A1 11/2003
WO 2012057342 A1 5/2012

* cited by examiner

TWO-LIQUID DISCHARGE CONTAINER

FIELD OF INVENTION

The present invention relates to a two-liquid discharge container. Specifically, the present invention relates to a two-liquid discharge container which is to independently store two liquids in one container, and which can easily discharge in mixed state or which can discharge two liquids independently at same time and mix afterwards.

DESCRIPTION OF BACKGROUND ART

The patent document 1 discloses a two-liquid discharge container equipped with an inner bag made of synthetic resin to be inserted in the container body made of metal, which can store two different concentrates. This inner bag has a constriction portion in the middle, and the interior of the inner bag is vertically divided into two storages by inserting the plug in the constriction portion.

In this two-liquid discharge container, concentrates are charged in two storages respectively, and the propellant (pressurized gas) is charged between the container body and the inner bag. And the concentrates are to be discharged by the pressure of the propellant. However, because only the concentrates in the inner bag is discharged, it was not possible to discharge the concentrate in foam or in mist.

Further, the inner bag is made of thin and soft synthetic resin where it is to be clashed by the propellant and is filled with the concentrate in liquid-tight condition, therefore, there is a problem, when the two concentrates are stored for extended period of time, that the content in one storage move to other storage by infiltrating the inner bag and reacts with other concentrate.

In FIG. 14 of patent document 2, plural-liquid discharging aerosol container having a container body made of synthetic resin where the pouch filled with concentrate is stored and where the liquefied gas is stored in same space is disclosed. In this aerosol container, plural contents are stored in one container body, and the discharging state of the content can be changed by liquefied gas. However, because the pouch is soaked in the content including the liquefied gas, there is a problem that the contents reacts with each other and be degraded, unless the means to prevent the penetration of the content through the bonding portion of the pouch is provided.

In patent document 3, a two-liquid discharge system having a first aerosol container with the dispensing member (push button), and a second aerosol container without the dispensing member, where the concentrate and the liquefied gas are stored in each container and where the second aerosol container is coupled to the bottom of the first aerosol container when in use, is disclosed. In this system, the separate storage of two concentrates is secured and the manufacturing is easy. However, two aerosol containers are necessary, and the liquefied gas may leak from the coupling portion.

In FIG. 3a of patent document 1, an aerosol valve in which two liquids are to be mixed in the housing and discharged outside is disclosed. Further, in FIG. 3b of patent document 1, an aerosol valve having two stem rubbers positioned one above another, where two liquids are discharged outside independently through two passage arranged in parallel in the stem, is disclosed. Moreover, in FIG. 3 and FIG. 5 of patent document 2, a valve assembly having two passages concentrically formed in the stem for two liquids to be discharged, is disclosed.

PRIOR ART DOCUMENTS

Patent Documents

Patent Document 1: Japanese patent No. 4286154 (WO2003/091128)
Patent Document 2: WO2012/057342A1
Patent Document 3: Japanese published patent application No. 2004-322030

DESCRIPTION OF THE INVENTION

Problems to be Solved

The present invention is directed to provide a two-liquid discharge container which can stably store two or more liquids, which can be easily mix the stored liquids, which can discharge the liquid in varied state such as in foam, mist, and etc., and which can prevent the reaction of the liquids when kept for long period of time.

Means of Solving the Problem

The present invention of a two-liquid discharge container is characterized in that it comprises a container body made of non-metal material, a partition wall member vertically dividing an interior of the container body into plural of storages, and a valve having a discharge passage communicating storages with outside, where contents are charged in each storage, where at least one of the content contains a liquefied gas, and where a gas lies between a liquid charged in the lower storage directly below the partition wall member and the partition wall member. Especially, it is preferable that the container body is made of synthetic resin or glass.

In the two-liquid discharge container of the present invention, it is preferable that the container body has a constriction portion between the storages, in which the constriction portion is radially contracted, and where the storages are partitioned by inserting the partition wall member in the constriction portion.

In the two-liquid discharge container, it is preferable that the discharge passage is composed of a first discharge passage communicating the upper storage with outside, and a second discharge passage communicating the lower storage with outside.

Especially, it is preferable that a pouch is housed in at least one storage, and where a concentrate of the content is charged in the pouch and a propellant of the content is charged in the storage outside of the pouch.

In the two-liquid discharge container of the present invention, it is preferable that the first discharge passage and/or the second discharge passage communicates with a gas phase in the respective storages in an stand-up condition, and the first discharge passage and/or the second discharge passage communicates with a liquid phase in the respective storages in an inverted condition.

On the other hand, it may be that the first discharge passage and/or the second discharge passage communicates with a liquid phase in the respective storages in a stand-up condition.

Especially, it is preferable that it comprises a first tube passage communicating the upper storage with the valve and a second tube passage communicating the lower storage with the valve, and where the first tube passage and the second tube passage are arranged concentrically.

In the two-liquid discharge container of the present invention, it is preferable that the partition wall member is a stretchable saclike member, and where the partition wall member divides the interior of the container body when filled with a gas and the storages are communicated when the gas is released.

Effect of the Invention

In the two-liquid discharge container of the present invention, because it is equipped with a container body made of non-metal material, it can stably store contents which react with the metal. Further, because the interior of the container body is vertically partitioned by the partition wall member and the gas lies between the liquid charged in the lower storage directly below the partition wall member and the partition wall member, the liquids (concentrates) are not adjacently stored with the thin synthetic resin coating or such in between. Therefore, the liquid will not infiltrates the synthetic resin coating and liquids (concentrates) will not be degraded by reacting with each other. As a result, the stability of the product is high. Especially, when the container body made of synthetic resin or glass is used, it can stably store the contents and the manufacturing is easy.

Further, because at least one of the content contains a liquefied gas, the liquefied gas mixed in the concentration vaporizes and expands when in discharging. Therefore, the liquid concentration such as liquid, cream, gel, etc. can be discharged in preferable condition such as foam, sparkling cream, sparkling gel, cream or gel with the air bubble dispersed in side, mist, etc. For example, in the case of two-liquid type hair dye, by controlling the hardness of the foam or sparking cream, it can easily mix two concentrates, or it can easily spread the concentrate to the hair, etc., or it can prevent the drip off of the concentrates from the hair, etc.

In the case where the container body has a constriction portion between the storages, the constriction portion is radially contracted, and where the storages are partitioned by inserting the partition wall member in the constriction portion, the partition wall member can made to be small, and the inserting of the partition wall member into the container body will be easy. Especially, it is preferable to have the inner diameter of the constriction portion to be substantially same as the inner diameter of the opening of the container body, or smaller than the inner diameter of the opening of the container body.

In the case where the discharge passage is composed of a first discharge passage communicating the upper storage with outside, and a second discharge passage communicating the lower storage with outside, the contents can be independently supplied from respective storage to outside through the tip of the valve, therefore, contents will not be mixed in the passage (inside the aerosol container). Therefore, it can be used repeatedly with the time in between.

In the case where a pouch is housed in the storage, and where a concentrate of the content is charged in the pouch, the concentrate can be stably stored without directly contacting the container body made of synthetic resin, even if the concentrate is a agent which converts the container body made of synthetic resin (polyethylene terephthalate), such as a first agent (alkaline agent) of the two-liquid type hair dye. Therefore, two liquids can be stored in stable condition. Further, because the propellant of the content is charged in the storage outside of the pouch, it can prevent the other content to penetrate into the pouch.

In the case where the first discharge passage and/or the second discharge passage communicates with a gas phase in the respective storages in a stand-up condition, and the first discharge passage and/or the second discharge passage communicates with a liquid phase in the respective storages in an inverted condition, because the discharge passage will be filled with air in the stand-up condition, it can prevent the mixture of two liquids inside the discharge passage, even if the contents are agents which infiltrates the synthetic resin of poly-acetal, etc, such as two-liquid type hair dye and the partition wall member is made of synthetic resin. Therefore, it can store the contents more stably. And by inverting the container body when in use, the liquids in the storage moves to the upper side and the discharge passage communicates the liquid part (liquid phase) with the outside, and the contents can be discharged outside. Further, after the discharging, by storing the two-liquid discharge container in the stand-up condition, the discharge passage once again will be filled with the gas and the gas will isolates two liquids for the contents to be stored stably.

The two-liquid discharge container may be structured to be used in the stand-up condition, where the first discharge passage and/or the second discharge passage communicate with a liquid phase in the respective storages in a stand-up condition. In this case, handling during the discharge operation, is easy, even if the container body is heavy.

In the case of the two-liquid discharge container of the present invention, where a first tube passage communicating the upper storage with the valve and a second tube passage communicating the lower storage with the valve are comprised, and the first tube passage and the second tube passage are arranged concentrically, because the structure of the discharge passage in the container body will be simple, the handling of the discharge passage during the assembling will be easy.

In the case of the two-liquid discharge container of the present invention, where the partition wall member is a stretchable saclike member, and the partition wall member divides the interior of the container body when filled with a gas and the storages are communicated with each other when the gas is released, two liquids can be stably stored. And storages can be communicated by releasing the gas in the partition wall member. Therefore, each content in the storages can be mixed in the container body before discharging.

EMBODIMENT FOR CARRYING OUT THE INVENTION

Figure 1:
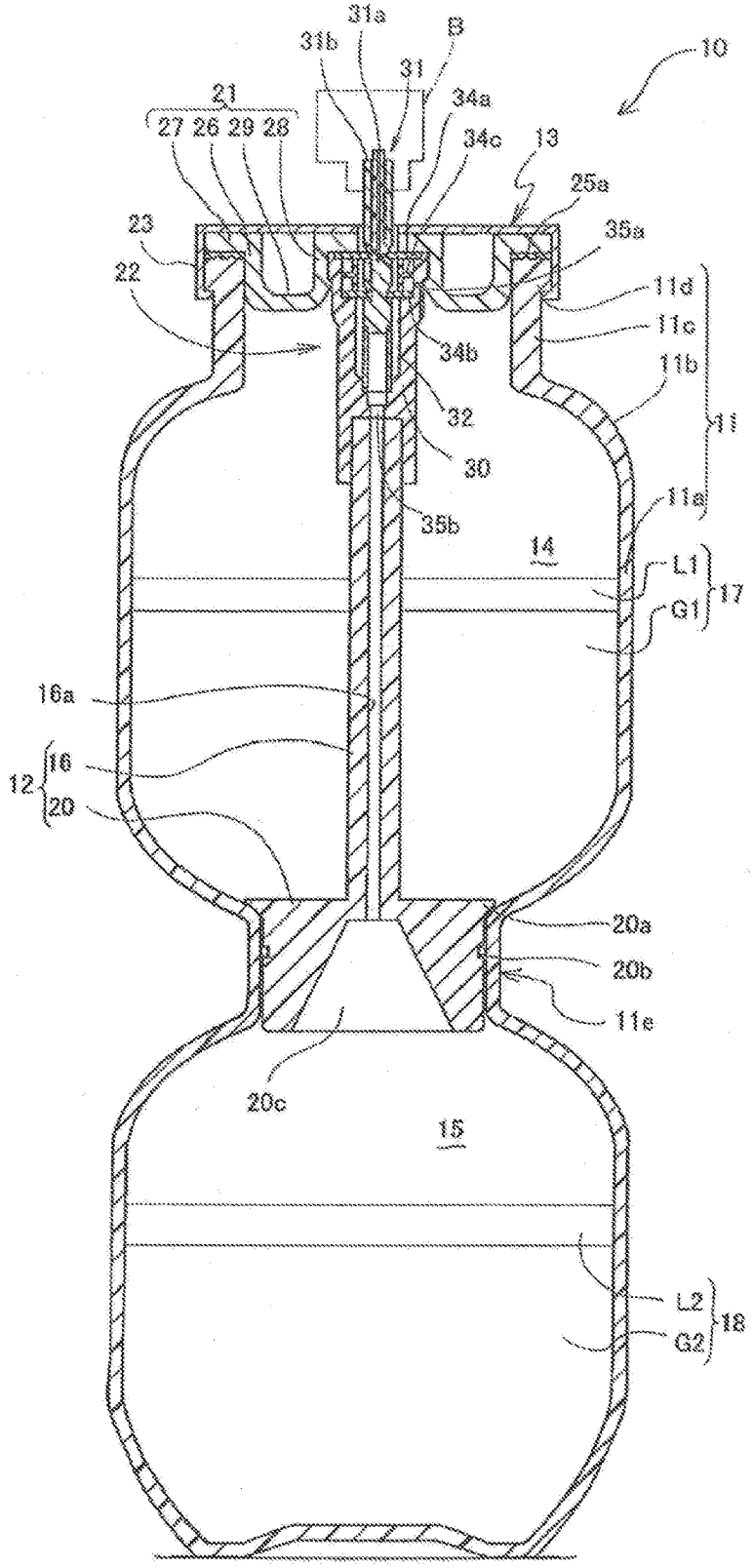
FIG. 1 is a cross sectional view showing an embodiment of the two-liquid discharge container of the present invention.

A two-liquid discharge container 10 of FIG. 1 is equipped with a container body 11 made of synthetic resin; a partition wall member 12 which divides the inside of the container body vertically; a valve assembly 13 which closes the top opening of the container body 11 and which opens and closes a pass between the inner space and the outside. The partition wall member 12 hermetically divides the inside space of the container body into an upper storage 14 and a lower storage 15, and is equipped with a pipe 16 which communicates the valve assembly 13 with the lower storage 15. In this embodiment, the pipe 16 is made of synthetic resin and integrally formed with a partition wall portion 20. However, the pipe 16 and partition wall portion 20 may be made of metal. In the two-liquid discharge container 10, the first content 17 including the liquid concentrate G1 and the liquefied gas L1 and the second content 18 including the liquid concentrate G2 and the liquefied gas L2 are stored in the upper storage 14 and the lower storage 15, respectively.

The container body 11 has a constriction portion 11*e* which is radially contracted and which is formed between the upper storage 14 and the lower storage 15. Specifically, it is a pressure resisting container made of synthetic resin which comprises a barrel portion 11*a* of a tube shape having a bottom portion, a shoulder portion 11*b* of a tapered shape formed on top of the barrel portion, a neck portion 11*c* of a tube shape formed on top of the shoulder portion, and a flange 11*d* formed on top and outer periphery of the neck portion. The constriction portion 11*e* of an approximately tube shape is formed on the midway of the barrel portion 11*a*. The container body 11 presents like gourd shape as a whole. Each of the inner surface of the neck portion 11*c* and the inner surface of the constriction portion 11*e* is smooth tube face. It may be little tapered.

For the synthetic resin of the container body 11, a material which will not be eroded by the stored contents is selected. The container body 11 is formed by biaxial stretching blow molding using a thermoplastic resin such as polyethylene terephthalate, polycyclohexane dimethylene terephthalate, polyarylate, nylon, etc, may be adopted. For example, heating a parison formed by injection molding, and forming in predetermined configuration by stretching or inflating the parison in axis direction in the die. The neck portion 11*c* and the flange 11*d* is common with the parison, it is not to be stretched, so it is made to be thick. The container body 11 may be provided with translucency and may be made from the synthetic resin having translucency. In this case, the remaining and the condition of the contents may be sighted. Further, to protect the contents from the ultraviolet, the inner surface or the outer surface of the container body 11 may be coated with carbon, alumina, silica, etc.

The partition wall member 12 comprises a partition wall portion 20 of a column shape which engages with the inner surface of the constriction portion 11*e*, and a pipe 16 extending upwardly from the middle of the partition wall portion 20, where it has a corrosion resistance against the contents as a whole, and where it is made of synthetic resin. For enhancing the gas barrier properties and preventing the infiltration of the contents (liquid concentrate), a tube (see note 16*b* of FIG. 2) or a circular disk made of metal such as stainless steel may be assembled. And a metal sheet or metal foil may be under-laid and metal may be vapor deposited according to the portions. On top and outer periphery of the partition wall portion 20, an engage flange 20*a* which engages with the inner wall of the upper storage 14 is formed. A circular groove or channel is formed on the outer surface of the partition wall portion 20, and the O-ring 20*b* is fixed to the circular groove.

On bottom surface of the partition wall portion 20, a depressed portion 20*c* of a conical shape or a truncated cone shape which narrows upwardly is formed. And a hole 16*a* of the pipe 16 is extended to the top surface of the partition wall portion 20. In this embodiment the partition wall portion 20 and the pipe 16 are integrally formed, however, it may be formed separately. In that case, both are to be coupled hermetically.

The valve assembly 13 is equipped with a valve holder 21 fixed to the opening of the container body 11, a valve mechanism 22 housed in the middle of the valve holder 21, and a mount cover 23 for fixing the valve holder 21 to the container body 11.

The valve holder 21 has an outer cylindrical portion (circular wall) 26 which is to be inserted and fitted in the neck portion 11*c* of the container body 11; a flange 27 which extends outwardly from the top of the outer cylindrical portion and which engages with the top of the neck portion 11*c*; an inner cylindrical portion 28 which holds the valve mechanism 22 and has a tube shape with a ceiling; and a coupling portion 29 which connects the bottom of the outer cylindrical portion 26 and the inner cylindrical portion 28. The flange 27 of the valve holder 21 and the top of the neck portion 11*c* of the container body 11 are sealed with a gasket 25*a* of ring shape in between. The valve holder 21 is made of synthetic resin. The mount cover 23 which is covers the valve holder 21 is made of metal thin plate such as aluminum thin plate, etc. The bottom of the outer peripheral wall of the mount cover 23 is to be deformed to the under surface of the flange 11*d* of the neck portion of the container body for fixing. By using the valve holder 21 and the mount cover 23, the neck portion 11*c* having large diameter may also be securely closed and sealed.

The valve mechanism 22 is equipped with a housing 30 of a tube shape with a bottom; a stem 31 housed movably in vertical direction in the housing 30, and a spring 32 which forces the stem upward. The stem 31 has an outer tube (large diameter tube) and an inner tube (small diameter tube) concentrically inserted in the outer tube with interval, in which the top of the inner tube is to be protruded from the top of the outer tube. The center hole of the small diameter tube is a first stem passage 31*a* which communicates with the upper storage 14 through the upper space of the housing 30. The space between the large diameter tube and the small diameter tube is a second stem passage 31*b* which communicates with the lower storage 15 through the lower space of the housing 30 and the pipe 16. In this embodiment, the second stem passage 31*b* surrounds the first stem passage 31*a*. However, two stem passages may be arranged in parallel like in patent document 1. That is, in this embodiment, the discharge passage comprises two passages in which each passages independently communicates each storages with outside.

The bottom of the first stem passage 31*a* of the stem communicates with the first stem hole extending in radial direction, and the bottom of the second stem passage 31*b* of the stem communicates with the second stem hole below the first stem hole. The first stem hole and the second stem hole are closed by the first stem rubber 34*a* and the second stem rubber 34*b*, respectively, and both are freed when the stem 31 is lowered. The space between the first stem rubber 34*a* and the second stem rubber 34*b* is communicated with the upper storage 14 through the upper communicating hole 35*a* formed on the lateral wall of the housing 30. The space below the second stem rubber 34*b* is communicated with the lower storage 15 through the bottom hole 35*b* of the housing 30 and the pipe 16 of the partition wall member 12. That is, the inside of the housing 30 is divided into one above the other by the second stem rubber 34*b*. Further, the spacer 34*c* having cross sectional shape of letter "T" is arranged between the first stem rubber 34*a* and the second stem rubber 34*b*, for maintaining the gap between the two and for securing the simultaneous opening and the closing of the stem holes. The spacer 34*c* has a slit which communicates the inside with outside.

When the stem 31 is lowered, the valve mechanism 22 opens the upper storage 14 to the outside through the first discharge passage composed of the upper communicating hole 35*a* of the housing 30, the first stem hole, and the first stem passage 31*a*; and the lower storage 15 to the outside through the second discharge passage composed of the pipe 16, the bottom hole 35*b* of the housing 30, the second stem hole, and the second stem passage 31*b*. And because the inside space of the housing 30 is partitioned into two by the second stem rubber 34*b*, the first content 17 in the upper storage 14 and the second content 18 in the lower storage will not be mixed until discharged outside. And both contents can be mixed after dispensed outside. Such a two-liquid independently dispensing type valve mechanism is also disclosed in Patent document 1. Further, the dispense amount of each content can be controlled by the amount of smallest sectional area of each passage communicating each storage with the outside, and the inner pressure of each storage. For example, when both storages have same inner pressure, the dispensing amount can be equalized by equalizing the smallest sectional area.

The first content 17 charged in the upper storage 14 includes the liquid concentrate G1 having beneficial effect and the propellant for dispensing the liquid concentrate G1 outside, and the second content 18 charged in the lower storage 15 includes the liquid concentrate G2 having beneficial effect and the propellant for dispensing the liquid concentrate.

The first liquid concentrate G1 of the first content 17 and the second liquid concentrate G2 of the second content 18 are stored separately and mixed when in use. For example, two-liquid reactive oxidation hair dye composed of a first liquid concentrate including color dye such as paraphenylenediamine, etc., and a second liquid concentrate including oxidant such as hydrogen peroxide, etc., which oxidize the color dye; two-liquid reactive cream (moisturizing cream, cleansing cream, massage cream, etc.) or two-liquid reactive foam (shaving, treatment, etc.) composed of a first concentrate of none aqueous liquid including mineral salt such as magnesium chloride, etc., and a second concentrate of water which reacts with the mineral salt, where the heat is generated when reacted; two-liquid reactive foam (face wash foam, shampoo foam, etc.) and two-liquid reactive lotion (cosmetic lotion, tonic lotion, etc.) for good blood circulation composed of a first concentrate including organic acid such as citric acid, etc., and a second concentrate including carbonate such as sodium carbonate, etc., where the carbon dioxide is generated by degradation of the carbonate with the acid, may be cited.

Further, two-liquid reactive gel (usage is not limited, hair cosmetic gel, anti-inflammatory analgesic gel, cooling gel, etc.) which thickens by neutralization composed of a first concentrate including water soluble polymer which thickens in alkali condition such as carboxy vinyl polymer, etc., and a second concentrate including alkali solution neutralizing the water soluble polymer; two-liquid reactive gel (usage is not limited, hair cosmetic gel, anti-inflammatory analgesic gel, cooling gel, etc.) which thickens by neutralization composed of a first concentrate including water soluble polymer which thickens in acidic condition such as polyacrylate-1, etc., and a second concentrate including acidic solution neutralizing the water soluble polymer; two-liquid reactive cream or foam having a first concentrate including polyalcohol such as glycerin, ethylene glycol, etc., and a second concentrate including small amount of water which reacts with the polyalcohol generating the heat; or two-liquid non reactive agents used in order such as shampoo and hair conditioner, or cleansing cream and skin care cream, etc., may also be cited.

At least one of the propellants is a liquefied gas and is charged in the storage. For the liquefied gas, liquefied petroleum gas, dimethyl ether, hydrofluoroolefin and mixture of any may be used. Liquefied gas may be charged in both of the storage (see FIG. 1) and it may be stored only in either one. When concentrate including the liquefied gas is dispensed outside, the liquefied gas expands and the liquid concentrate can be dispensed in a foam, in a soft gel with small bubbles (sparkling gel), or in a soft cream with small bubbles (sparkling cream). If the contents are discharged in a foam, in soft gel with small bubbles, or in soft cream with small bubbles, the drip off can be prevented and blending is easy. Further, it may be sprayed in fine mist. For the propellant of the other concentrate, the pressurized gas such as nitrogen gas, carbon dioxide gas, air, etc. may be used.

The two-liquid discharge container 10 of FIG. 1, is an aerosol container used in upside down condition, in which neither the dipping tube communicating the liquid phase of the contents in the upper storage 14 with the valve nor the dipping tube communicating the liquid phase of the content in the lower storage 15 with the valve were applied. And dispensing member (push button) B is attached to the stem 31, when in use. Therefore, when discharging the contents from the storages, it is turned upside down. That is, the liquid phases of each concentrate G1, G2 and liquid phase of each liquefied gas L1, L2 in each storages 14, 15 will be moved to the lower side, that is the upper side when in upstand condition. And the first content 17 in the upper storage 14 is flowed into the upper space in the housing 30 through the communicating hole 35*a* of the lateral wall of the housing 30. Also, the second content 18 in the lower storage 15 is flowed into the lower space in the housing 30 through the pipe 16. Because the depressed portion 20*c* is formed on the partition wall portion 20, the second concentrate G2 can be flowed smoothly despite the high degree of viscosity.

At this condition, the dispensing member B fixed to the stem 31 is pushed downward. Therefore, the first concentrate G1 and the liquid phase of the first liquefied gas L1 are discharged outside from the upper storage 14 through the first stem passage 31*a* and dispensing member B. It is preferable to shake the container body 11 before operating, for mixing the concentrate and the liquid phase of the liquefied gas. And at the same time the first content 17 is discharged outside from the upper storage 14, the second content 18 is discharged outside from the lower storage 15 through the second stem passage 31*b* of the stem 31 and the dispensing member B. The contents 17, 18 will change into desired discharging state of foam, soft gel with small bubbles or soft cream with small bubbles, due to the expansion of the liquefied gas when discharged outside. And at the same time the contents are discharged, it is to be mixed. Therefore, the mixture can be used according to the intended use, such as two-liquid hair dye applied to the hair, Because, the two-liquid discharge container 10 of FIG. 1 does not equipped with the dip tube which directly communicates with the liquid phase of the contents stored in the storages 14, 15, the first concentrate G1 and the second concentrate G2 are positioned on the lower side of storages. And between two concentrates there is the gas phase of the liquefied gas L2 charged in the lower storage 15. Therefore, the liquid phase of the first content 17 infiltrates the partition wall member 12 and reacts with the second content 18 can be prevented, and the degradation of the product can be prevented. Further, since this is a discharge container for inverted use, the liquid content will not exists in the second passage 31*b* (inside of the housing 30 or pipe 16), because the second passage 31*b* will be filled with the gas phase of the liquefied gas L2 in standup condition. Therefore it prevents the second content to infiltrates the housing or the pipe and prevents the reaction between the first content 17 and the second content 18. The dispensing member B, such as the spout, push button, etc. can be cleaned after unfixing it.

For the method to charge the contents into the two-liquid discharge container 10 of FIG. 1, for example, the contents may be charged by charging the second concentrate G2 into the lower storage 15, fixing the partition wall member 12 to the restriction portion, charging the first concentrate into the upper storage 17, fixing and sealing the valve assembly 13 to the container body, and charging the propellant from stem 31. The liquefied gas (propellant) L1, L2 can be independently charged through each discharge passage from the stem to storages 14, 15, because the first discharge passage from the first stem passage 31*a* of the stem 31 to the upper storage 14 and the second discharge passage from the second stem passage 31*b* of the stem 31 to the lower storage 15 of the valve mechanism are independent to each other. And the liquefied gas may be simultaneously charged. Further, the concentrate may also be charged through the valve, after the partition wall member 12 and the valve assembly 13 are fixed to the container body. Moreover, the charging of the liquefied gas into the upper storage 14 may be achieved by under-cup charging. In addition, it may be charged by mixing the concentrate and the liquefied gas in a cooled or a cooled high pressure condition where the vaporization of the liquefied gas is controlled. That is, by charging the second content 18 into the lower storage 15, closing the lower storage 15 with partition wall member 12, charging the first content 17 into the upper storage 14, and closing the container with the valve assembly 13.

Figure 2:
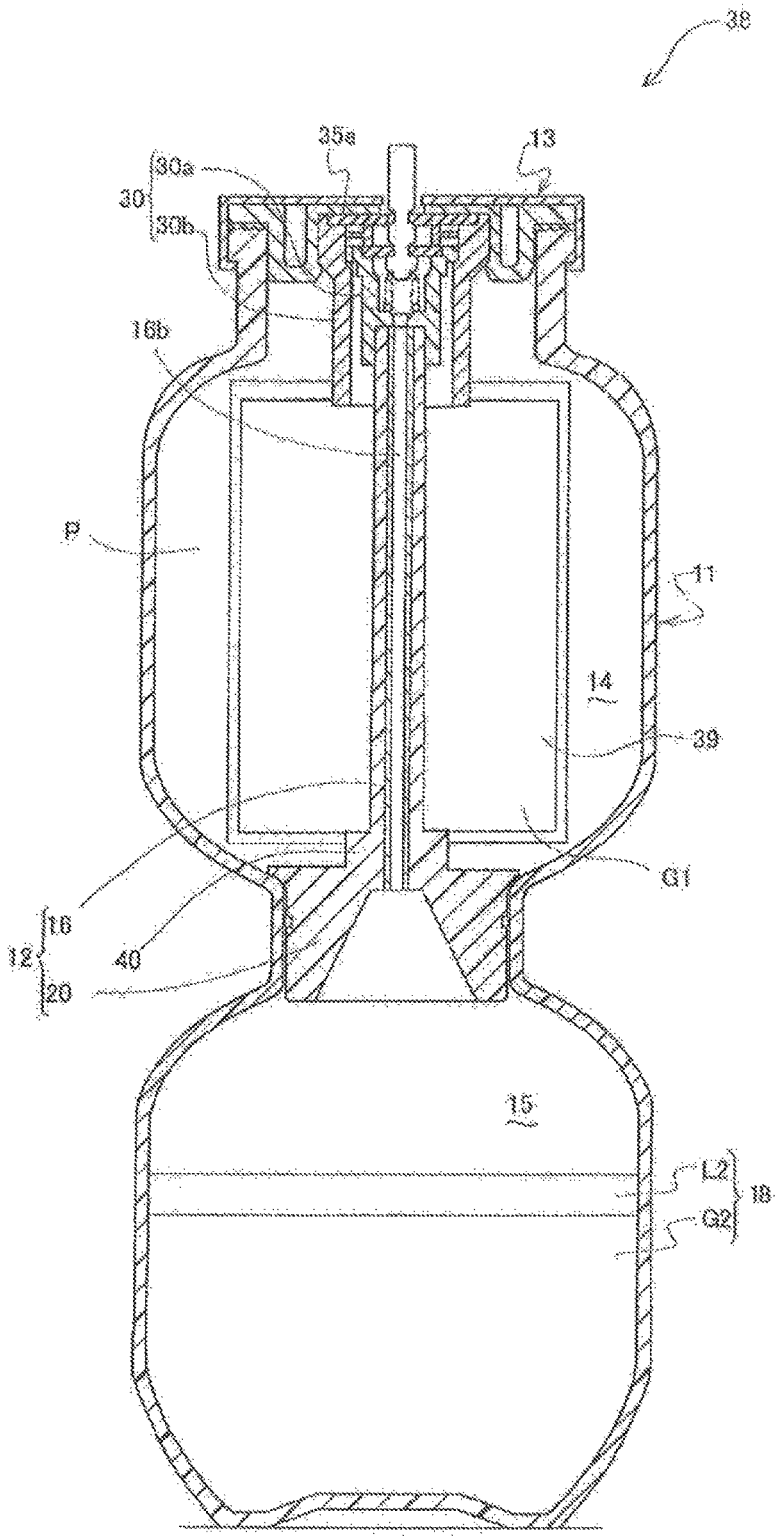
FIG. 2 is a cross sectional view showing another embodiment of the two-liquid discharge container of the present invention.

The two-liquid discharge container 38 of FIG. 2 has a pouch 39 which communicates with the upper communicating hole 35*a* of the housing 30 in the upper storage 14. The container body 11 and the partition wall member 12 are same as those of FIG. 1. This two-liquid discharge container 38 also is used in inverted (upside down) condition. The pouch 39 is made of a laminated material composed of the metal foil and the synthetic resin film. The pouch is manufactured by overlapping the laminated films and adhering the edge portions to form a bag. However, a bag may be formed by folding back one laminated sheet and adhering the three sides. The pipe 16 of the partition wall member 12 is to be sandwiched between two laminated sheets. Further in this embodiment, the housing of the valve mechanism is made to be double layer structure with an inner housing 30*a* and a tubular outer housing 30*b* formed outside of the inner housing 30*a* with a gap. The gap between the inner housing 30*a* and the outer housing 30*b* communicates with the space between the first stem rubber 34*a* and the second stem rubber 34*b* through the upper communicating hole 35*a*. A gas-impermeable tube, especially metal tube 16*b* such as stainless steel tube may be arranged in the inner surface of the pipe 16.

The bottom of the outer housing 30*b* is sandwiched between the two laminated sheets structuring the pouch 39 and adhered. Therefore, the upper communicating hole 35*a* can be communicated with the pouch 39 through the space in the outer housing 30*b*. The outer housing 30*b* may be configured to be in spindle shape in planar view, or in flattened shape to have the pouch 39 to be adhered easy. Further, a flattened protrusion 40 configured to be in plate shape or to be in spindle shape in planar view, may be provided on the upper surface of the partition wall portion 20 of the partition wall member 12, and have the protrusion 40 to be sandwiched between the two sheets of the pouch 39 and adhered.

Moreover, in this embodiment of FIG. 2, the outer housing 30*b* and the pipe 16 are to be arranged concentrically. However, in the case where the outer housing 30*b* and the pipe 16 are arranged in parallel, the pouch 39 may be arranged outside of the pipe 16, for example the bottom of the outer housing 30*b* is closed with the bottom plate and the communicating member (such as numeral 59 of FIG. 7) is fixed between the bottom plate and the pouch. In this case, the content stored in the pouch 39 infiltrating the pipe 16 may be prevented.

The space lower than the second stem rubber 34*b* which communicates with the lower storage 15 through pipe 16 is same as the two-liquid discharge container 10 of FIG. 1.

By fixing the upper part of the pouch 39 to the outer housing 30*b* and fixing the lower part of the pouch 49 to protrusion 40 of the partition wall member 12, the pouch 39 can be prevented from being bended and trail down and can be kept stably when two-liquid discharge container 38 is in inverted condition. The inside of the pouch 39 is filled with the first concentrate G1 of cream or liquid. The space between the container body 11 and the pouch 39 is filled with the propellant P such as pressurized gas. However, it may be liquefied gas. The second content 18 that is second concentrate G2 and the liquefied gas L2 charged in the lower storage 15 is substantially same as the two-liquid discharge container 10 of FIG. 1. In this embodiment, the first concentrate G1 in the pouch and the second content 18 in the lower storage are simultaneously discharged, while the discharging state of the first concentrate may be changed to the foam, etc. by the vaporization of the liquefied gas L2 of the second content.

For the method to charge the content in the two-liquid dispense container 38 of FIG. 2, for example, the contents may be charged by charging the second concentrate G2 in the lower storage 15, fixing the partition wall member 12, charging the propellant in the upper storage 15 by under-cup charging method, and fixing the valve assembly 13 to the container body. The contents are charged further, by vacuuming the air in the pouch 39 by lowering the stem 31, charging the liquefied gas L2 into the lower storage 15 through the second stem passage 31*b* of the stem 31, and by charging the first concentrate G1 into the pouch 39 through the first stem passage 31*a*.

Figure 3:
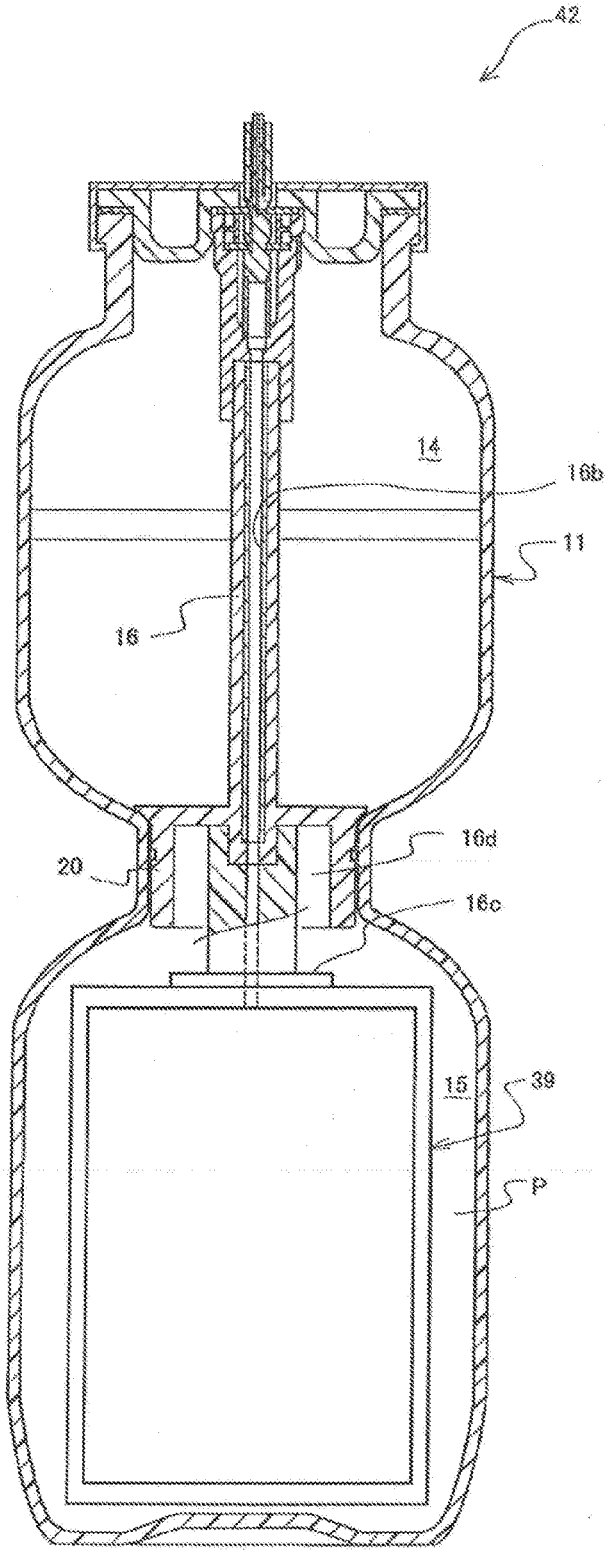
FIG. 3 is a cross sectional view showing the other embodiment of the two-liquid discharge container of the present invention.

The two-liquid discharge container 42 of FIG. 3 is equipped with the pouch 39 housed in the lower storage 15 opposite to the two-liquid discharge container 38 of FIG. 2, and the propellant P of pressurized gas is charged between the container body 11 and the pouch 39. The upper storage 14 of the two-liquid discharge container 42 is same as the two-liquid discharge container 10 of FIG. 1 and the lower storage 15 is same as the two-liquid discharge container 38 of FIG. 2. This two-liquid discharge container 42 also is used in inverted state. The pipe 16 is extended downwardly in the partition wall member 20 and the bottom of the pipe is engaged with the connecting member 16*d* having the flattened portion 16*c* of spindle shape in planar view. The connecting member 16*d* is sandwiched and adhered between the two sheets composing the pouch 39. Therefore, the top of the pouch 39 can be tightly engaged with the pipe 16. In this embodiment, because the second concentrate G2 exist in the pipe 16 in stand-up condition, it is preferable to apply the pipe 16 made of synthetic resin pipe in which the metal tube (note 16*b* of FIG. 2) such as stainless steel tube, is provided inside the synthetic resin pipe.

For the method to charge the content in the two-liquid discharge container 42 of FIG. 3, for example, the contents may be charged by charging the propellant P into the lower storage 15 by under-up charging, fixing the partition wall member 20, and fixing the valve assembly 13 to the container body 11. The contents are charged further, by vacuuming the air in the pouch 39 and vacuuming the propellant in the upper storage 14 by lowering the stem 31, by charging the second concentrate G2 into the pouch 39 through the second stem passage 31*b* of the stem 31, and by charging the first concentrate G1 and the liquefied gas L1 into the upper storage 14 through the first stem passage 31*a* of stem 31.

Figure 4:
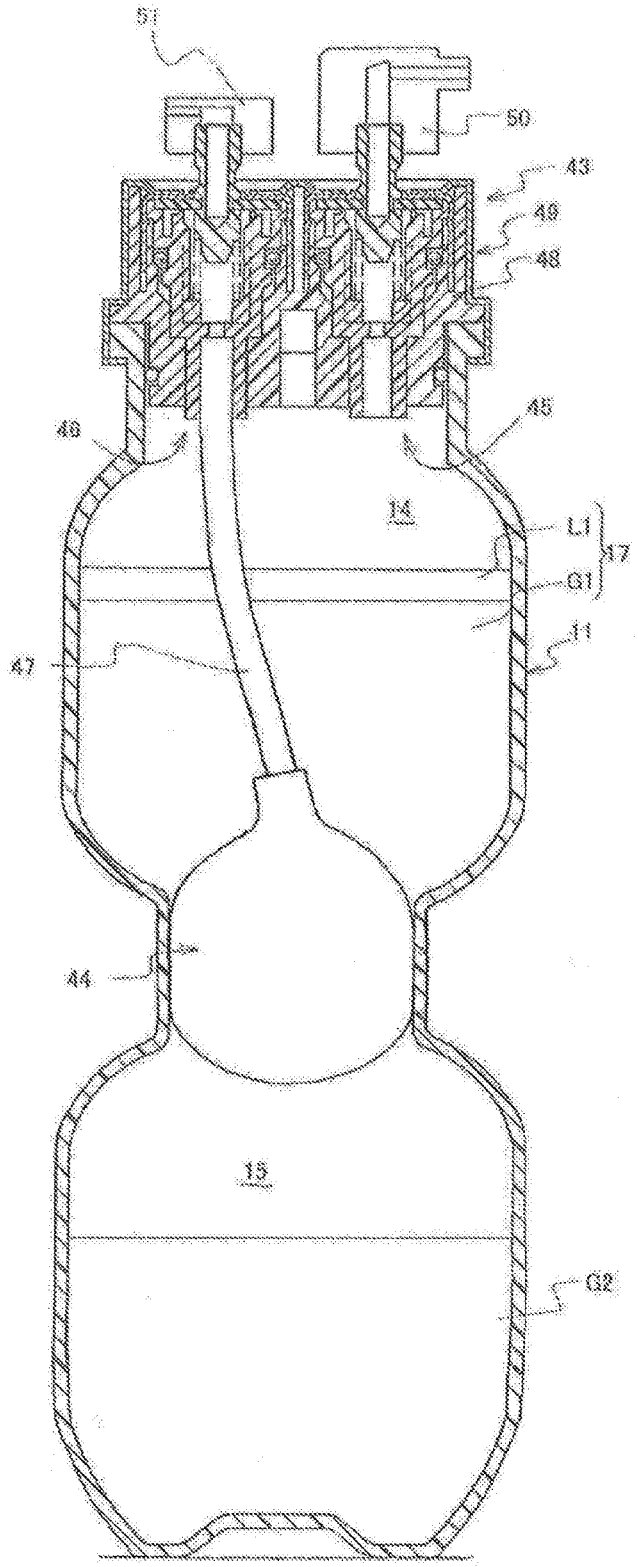
FIG. 4 is a cross sectional view showing the other embodiment of the two-liquid discharge container of the present invention.

The two-liquid discharge container 43 of FIG. 4 is a device which mixes two liquids in the container body 11 and dispenses the mixture, unlike said two-liquid discharge containers 10, 38, 42. That is, the two-liquid discharge container 43 has a partition wall member which partitions the upper storage 14 and the lower storage 15 and which can operate the opening and closing of the pass between the upper storage and the lower storage. For example, a balloon 44 which can expand and shrink is applied. Further, it has an opening valve 46 which discharge the gas in the balloon by operation, other than the dispense valve 45 dispensing the mixed content outside. A soft tube 44 or pipe communicates the balloon 44 with the opening valve 46. In the balloon 44, a pressurized gas of high stability, such as nitrogen gas, argon gas, etc. may be charged other than the air.

As for the valve assembly having the dispense valve 45 and the opening valve 46, it is preferable, for example, that it is assembled using one valve holder 48 holding two valves 45, 46 and cover cap 49 fixing the valve holder 48 to the container body 11. For such a double valve assembly, a valve assembly which simultaneously dispenses two contents disclosed in FIG. 14 of Patent document 2 may be substituted. In the embodiment of the FIG. 14 of Patent document 2, one dispensing member (push button) is fixed to the double valve assembly, however, in the valve assembly of FIG. 4, the valves are structured to be operated independently that is the dispense member 50 is fixed to the dispense valve 45 and the operate member 51 is fixed to the opening valve 46.

To use the two-liquid discharge container 43 of FIG. 4, the gas in the balloon 43 must be removed by lowering the operate member 51 of the opening valve 46 for the upper storage 14 and the lower storage 15 to be communicated. And then the first content 17 and the second concentrate G2 are mixed by shaking the container body 11. Next the dispense member 50 is lowered to open the dispense valve 45 in inverted state, and the mixed content is discharged outside. For such a mixed content, the contents shown in the two-liquid discharge container 10 of FIG. 1 can be applied. Further, because, the first content 17 and the second concentrate G are mixed in the container body 11, the propellant is to be charged in either of contents, and the discharging state can be changed with just one propellant. However, it is preferable to have the liquefied gas L1 charged in upper storage 14 storing the first content 17, and charge only the second concentrate G2 and not charge the propellant in lower storage 15 storing the second content. Therefore, the charging work can be simplified.

That is, in order to store the content, the second concentrate G2 is to be charged in the lower storage 15 and the valve assembly is to be fixed to the container body. Further, the lower storage 15 is closed by charging the gas into the balloon 44 through the opening valve 46 and expands the balloon 44. The space, in which the second concentrate G2 is not filled, is filled with air. In this condition, the lower storage 15 is not pressed, therefore the fixing operation of the balloon 44 and the closing operation of the lower storage 15 can be achieved easy. After that the first concentrate G1 is charged into the upper storage 14 through the dispense valve 45 and the liquefied gas is also charged. In this two-liquid discharge container 43 also, the first concentrate G1 and the second concentrate G2 is stored in a condition where the air and the balloon 44 filled with the gas is in between. Therefore, reaction between the contents due to the infiltration and degradation can be prevented, in contradistinction to the two concentrate adjacent to each other through the synthetic resin sheet. However, the propellant may be charged into the lower storage 15 and have the inner pressure to be same like the upper storage. In this case, the inner pressure of the upper and lower storage balances the balloon to be stabilized.

Figure 5:
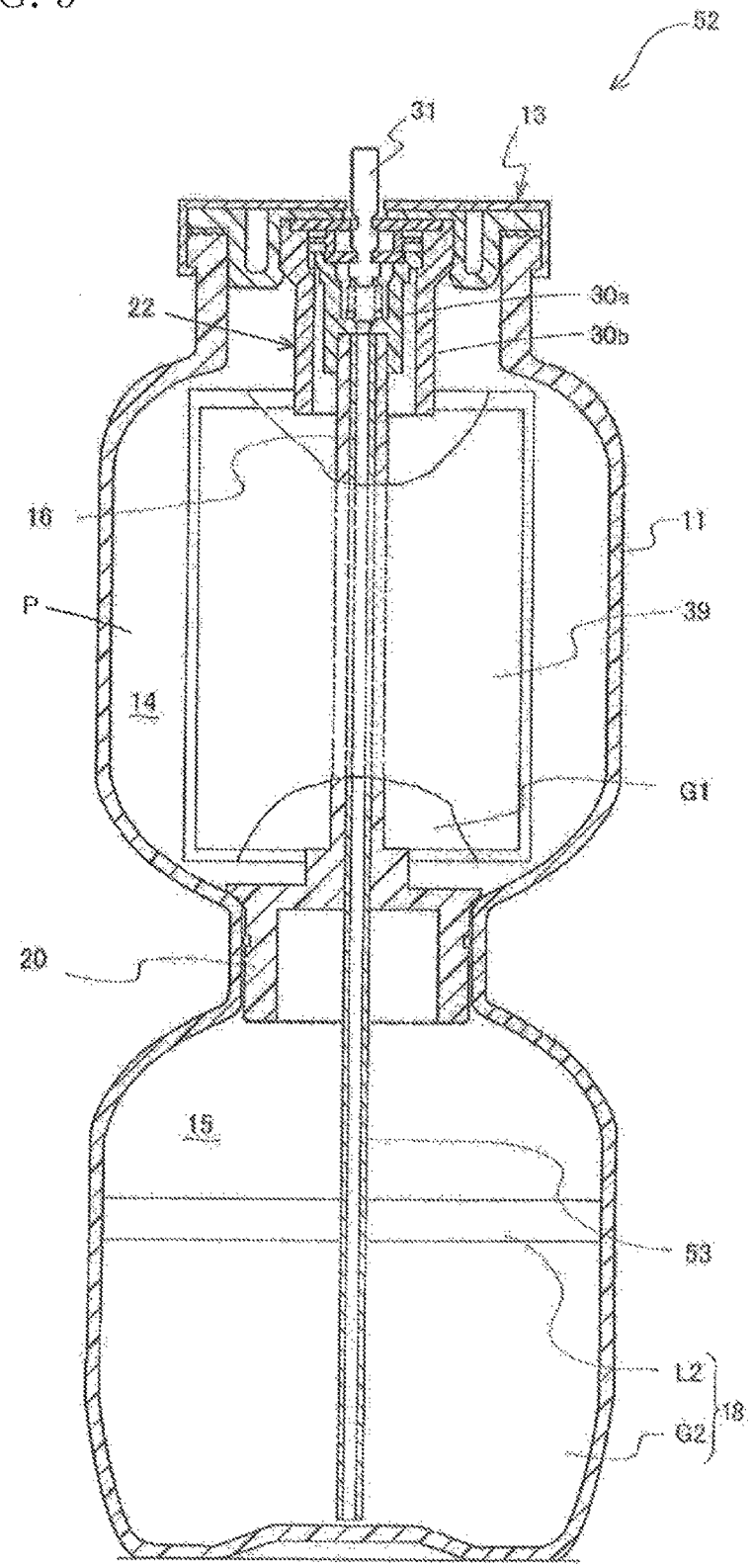
FIG. 5 is a cross sectional view showing the other embodiment of the two-liquid discharge container of the present invention.

In all of said embodiments, the two-liquid discharge containers were used in inverted state. However, the present invention may be used in stand-up condition. The two-liquid discharge container 52 of FIG. 5 is used in stand-up condition, which comprises a dip tube 53 extending downward from the metal tube 16*b* to the bottom of the lower storage 15. Other structures are substantially same as the two-liquid discharge container 38 of FIG. 2. In this two-liquid discharge container 52, when the valve mechanism 22 is operated, the first concentrate G1 is discharged from the pouch 39 due to the pressing of the propellant P and the second content in the lower storage is discharged from the stem 31 of the valve mechanism 22 through the dipping tube 53 and inner housing 30*a* due to the pressing of the liquefied gas L2. The first concentrate G1 and the second concentrate are changed into foam or into bubbles by the liquefied gas L2.

Figure 6:
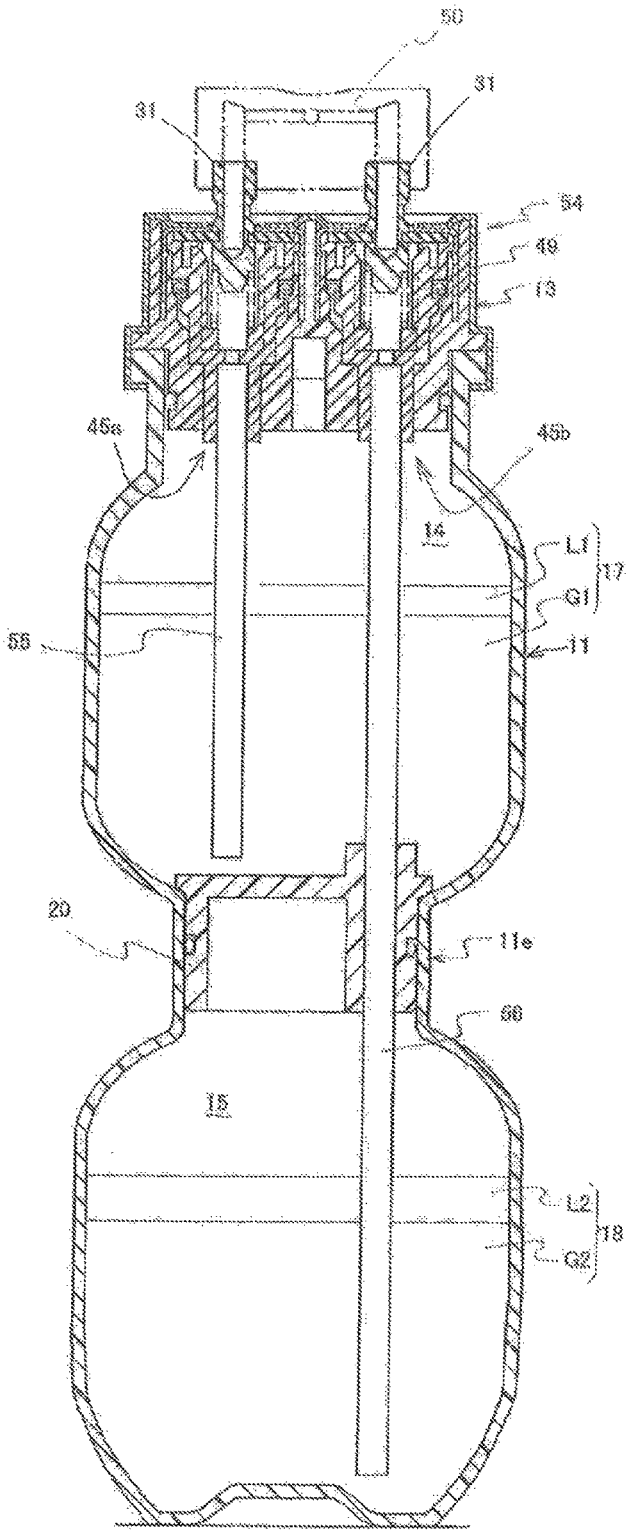
FIG. 6 is a cross sectional view showing the other embodiment of the two-liquid discharge container of the present invention.

The two-liquid discharge container 54 of FIG. 6 is made to be used in stand-up condition, in which dipping tubes 55, 56 are provided respectively in storages and neither have the pouch. That is, in this embodiment, the dipping tubes 55, 56 construct the first discharge passage and the second discharge passage of the discharge passage. The valve assembly 13 is substantially same as the double valves type of two-liquid discharge container 43 of FIG. 4, and two valves 45*a*, 45*b* for upper storage 14 and lower storage 15, respectively are held by the valve holder 48 and the cover cap 49. The dipping tube 55, 56 arranged in parallel communicates each storage 14, 15 with the valves 45*a*, 45*b*, respectively. One dispensing member is fixed to stems 31, 31 of two valves. The dipping tubes 55, 56 maybe made of soft material and maybe made of hard material, however the dipping tube 56 which communicates the valve 45*b* with the lower storage 15 is preferable to be metal tube such as stainless steel tube for shutting the inside from the first content 17. In this two-liquid discharge container 54, not only the partition wall portion 20 but also the gas phase of the liquefied gas L2 in the second storage 15 is positioned between the first concentrate G1 of the upper storage 14 and the second concentrate G2 of the lower storage 15. Therefore, the first concentrate and the second concentrate can be kept for long period of time without degrading.

Figure 7:
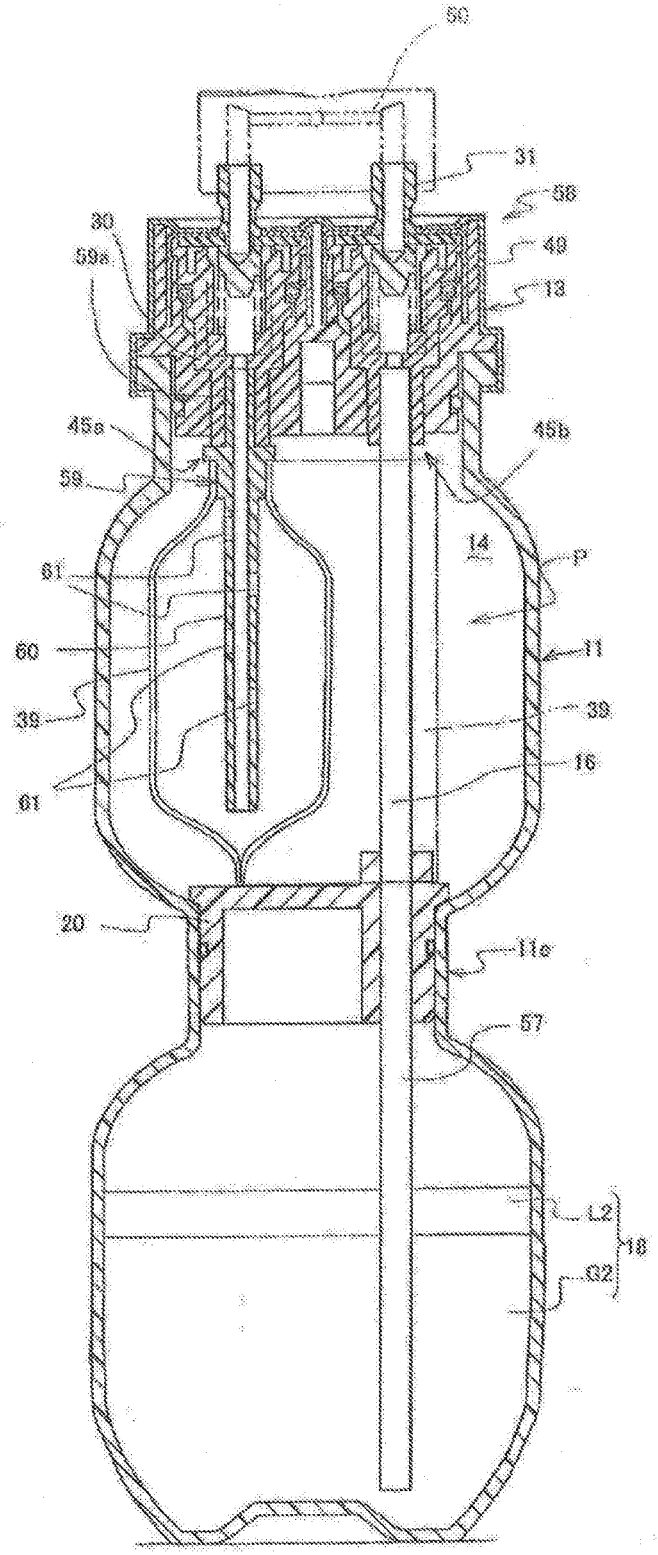
FIG. 7 is a cross sectional view showing the other embodiment of the two-liquid discharge container of the present invention.

The two-liquid discharge container 58 of FIG. 7 has a pouch 39 in upper storage 14 like two valves type two-liquid discharge container 54 of FIG. 6. The pouch 39 is connected to the valve 45*a* for upper storage using a tubular connecting member 59. In this embodiment, the upper tube portion 59*a* of the connecting member 59 is inserted in the housing 30 of the valve 45*a*, and the upper end portion of the pouch 39 is adhered to the outer periphery of the connecting member 59. The pipe 60 is engaged to the lower portion of the connecting member 59, so that the passage is secured even when the pouch is folded when discharging. Further, in order to secure the passage, plural of introducing holes 61 are formed on the pipe 60.

Figure 8:
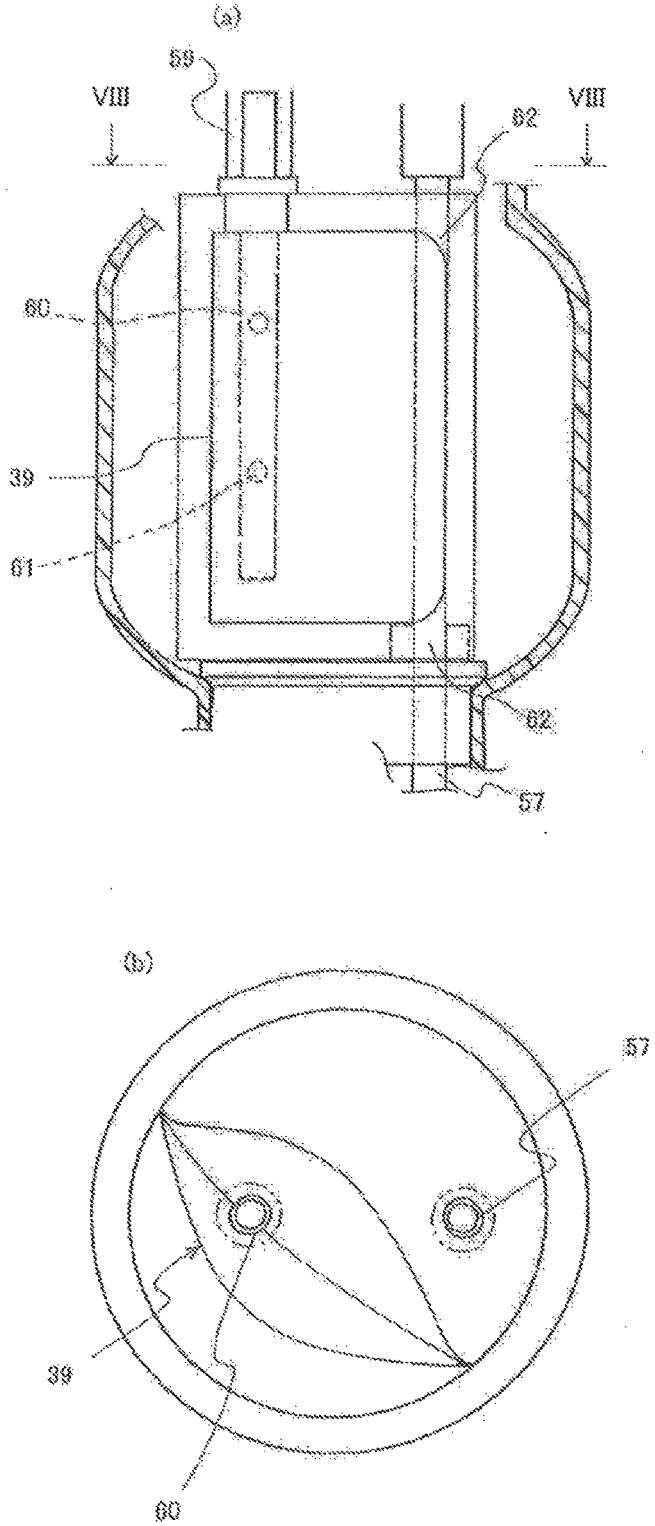
FIG. 8*a* is a front view showing the inside of the two-liquid discharge container of FIG. 7.
FIG. 8*b* is VIII-VIII line sectional view of FIG. 8*a*.

And like shown in FIG. 8*a*, horizontally long pouch 39 is employed and the connecting member 59 is fixed to the pouch 39 displacing from the center of the pouch 39. Therefore, like shown in FIG. 8*b*, the pouch can be positioned adjacent to the space near the dipping tube 57 of the lower storage without deeply bending the pouch and secure the volume of the pouch 39. Like in this embodiment, by positioning two storages up and down, the height of each storage can be structured to be low, but the volume can be gained by arranging the pouch horizontally long. The content tends to remain in the corner portion in the horizontally long pouch 39 therefore, it is preferable to form the corner portion 62 to be round and not form the corner edge when adhering two sheets.

Figure 9:
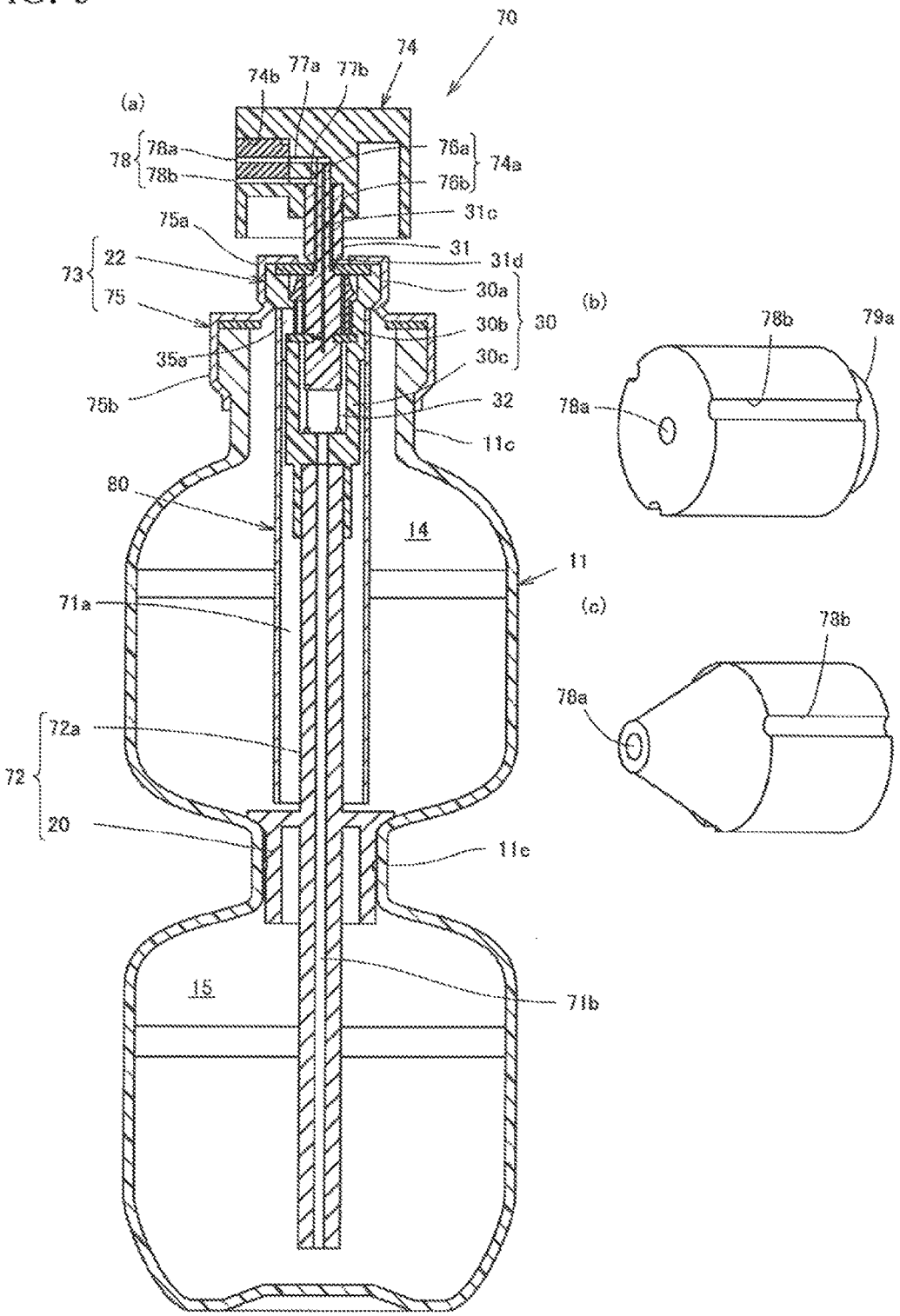
FIG. 9*a* is a cross sectional view showing the other embodiment of the two-liquid discharge container of the present invention.
FIG. 9*b*, FIG. 9*c* are perspective view showing the other embodiments of orifice tip, respectively.
Figure 10:
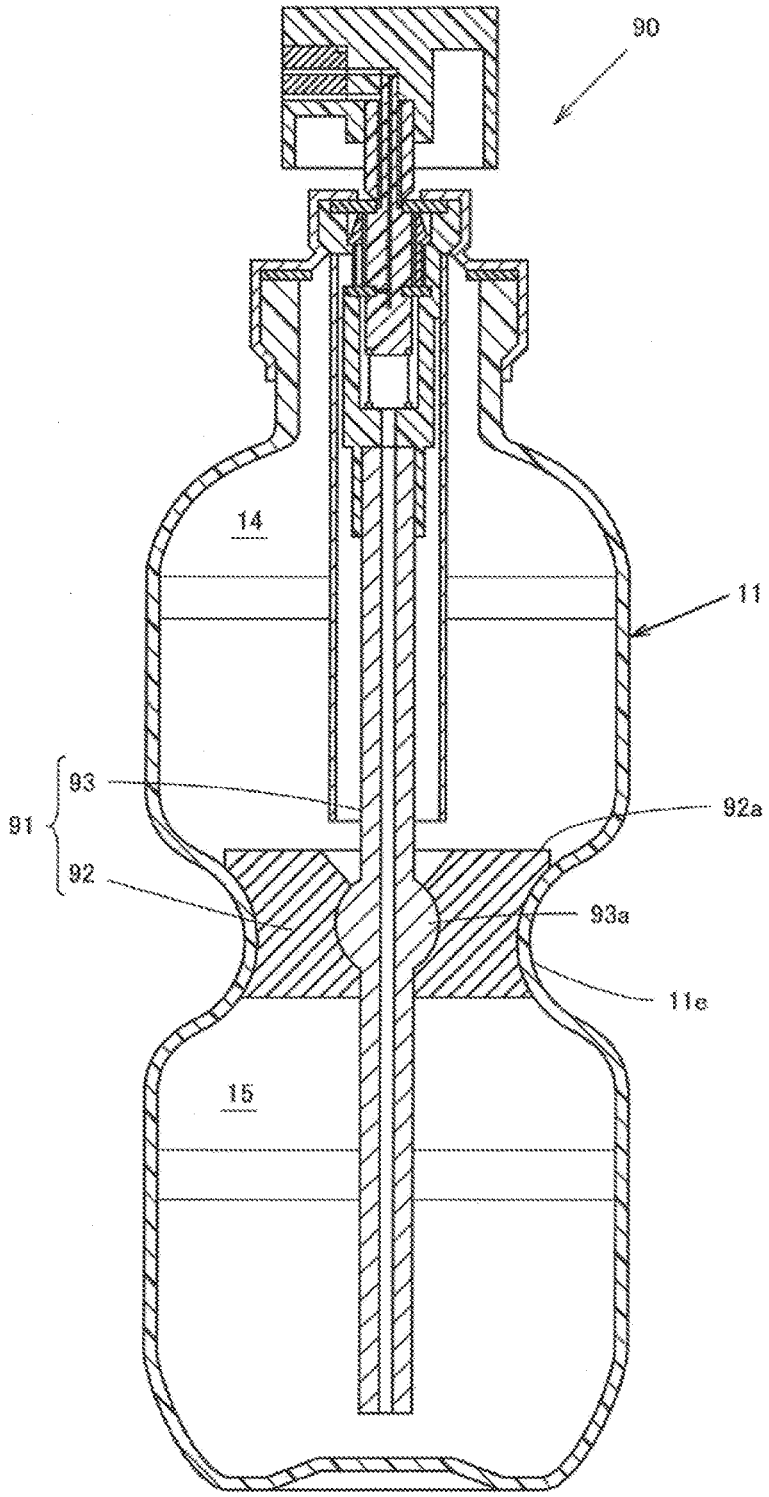
FIG. 10 is a cross sectional view showing the other embodiment of the two-liquid discharge container of the present invention.

The two-liquid discharge container 70 of FIG. 9 and the two-liquid discharge container 90 of FIG. 10 discharges the contents in upstand state, where the first tube passage 71*a* connecting the valve mechanism 22 with the upper storage 14 and the second tube passage 71*b* connecting the valve mechanism 22 with the lower storage 15 are provided concentrically. Both two-liquid discharge containers has an air between the second content stored in the lower storage 15 and the first content stored in the upper storage 14, therefore the chance that contents of both storages infiltrates to other storage and contents are to be mixed, is small.

The two-liquid discharge container 70 is equipped with a container body 11 made of synthetic resin, a partition wall member 72 dividing the inside space of the container body into one above the other, and a valve assembly 73 which closes the upper opening of the container body 11 and operates the opening and closing of the passages between each storage and outside. The dispensing member 74 is fixed to the valve assembly 73. The inner diameter of the constriction portion 11*e* is substantially same as the inner diameter of the neck portion 11*c* and the inner diameter of the parison, other than that it is substantially same as the container body 11 of FIG. 1. However, the inner diameter of the constriction portion 11*e* may be smaller than the neck portion 11*c*.

The partition wall member 72 has a partition wall portion 20 of column shape where it engages with the inner surface of the constriction portion 11*e* of the container body 11, and the inner dipping tube 72*a* which penetrates the partition wall portion 20 up and down. The lower end of the inner dipping tube 72*a* extends to the bottom of the lower storage 15. The partition wall portion 20 is substantially same as the partition wall portion 20 of partition wall member 12 of FIG. 1. In this embodiment, the partition wall portion 20 and the dipping tube 72*a* are formed integrally, but may be formed separately like in FIG. 5.

The valve assembly 73 is equipped with the valve mechanism 22, and the mounting cover 75 fixing the valve mechanism 22 to the container body 11. The valve mechanism 22 has housing 30, stem 31, and spring 32 and is substantially same as the valve mechanism 22 of FIG. 1, except that the center hole (second stem passage 31*c*) of the small diameter tube of stem 31 is communicated with the lower storage 15 through the second stem hole (lower stem hole) and the second tube passage 71*b* and the gap between the large diameter tube and the small diameter tube (first stem passage 31*d*) is communicated with the upper storage 14 through the first stem hole (upper stem hole) and the first tube passage 71*a*. Further, on the outer peripheral of the housing 30, the upper communicating hole 35*a* is formed penetrating the large diameter portion 30*b*. And the outer dipping tube 80 communicating the upper communicating hole 35*a* of the housing 30 with upper storage 15 is engaged to the outer peripheral of the large diameter portion 30*b* of the housing 30. And the outer dipping tube 80 is extended to the vicinity of the bottom of the upper storage 14. That is the outer dipping tube 80 houses the inner dipping tube 72*a* and the outer dipping tube 80 and the inner dipping tube 72*a* are positioned concentrically. The first tube passage 71*a* is a tubular space between the outer dipping tube 80 and the inner dipping tube 72*a* and the second tube passage 71*b* is a column space. The inside of the inner dipping tube 72*a* will be filled with the content of the lower storage once the valve is opened, it is preferably to provide the metal tube inside the inner dipping tube 72*a* made of metal pipe or synthetic resin pipe, like in two-liquid discharge container 42 of FIG. 3.

The mounting cover 75 directly holds the valve mechanism 22. Specifically, it has a valve holding portion 75*a* which covers the top opening of the housing 30 and pinches or sandwiches the upper flange portion 30*a* of the housing 30, and a container holding portion 75*b* which is engaged to the bottom of the valve holding portion 75*a*, which covers the top of the container body 11 through the sealing member 25*a*, and in which the bottom is engaged with the flange 11*d* of the container body.

The dispensing member 74 has a box like shape and comprises a stem engaging portion 74*a* formed on the bottom for inserting the stem 31 and a tip engaging portion

74*b* formed on the front for inserting the nozzle tip 78. The dispensing member 74 is for independently discharging two contents. Specifically, the stem engaging portion 74*a* is structured with a small diameter portion 76*a* which receives the small diameter tube of the stem 31, and a large diameter portion 76*b* formed concentrically below the small diameter portion and which receives the large diameter tube of the stem 31. The stem engaging portion 74*a* and the tip engaging portion 74*b* are connected respectively through the first dispensing member passage 77*a* extending forward from the top of the small diameter portion 76*a* and the second dispensing member passage 77*b* extending forward from top of the large diameter portion 77*b*.

The nozzle tip 78 has a column shape and comprises a center hole 78*a* which communicates with the first dispensing member passage 77*a* and a outer peripheral channel 78*b* which communicates with the second dispensing member passage 77*b*. However, a small diameter portion 79*a* may be formed on the base side and plural of outer peripheral channel 78*b* may be formed, like shown in FIG. 9*b*. Further, the nozzle tip may be made to be conically shaped where the outer diameter decreases in front direction. By having the nozzle tip to be in conically shape, the first content is gather to the center and can be easily mixes with the second content after discharged from the nozzle tip.

In the two-liquid discharge container 90 of FIG. 10, a constriction portion 11*e* of the container body 11 is curved inwardly, and the partition wall member 91 having elasticity is inserted in the constriction portion 11*e*. The constriction portion 11*e* is formed by narrowing using the die, etc., when blowing the parison. Other configuration is substantially same as the two-liquid discharge container 70 of FIG. 9.

The partition wall member 91 is composed of a tubular main body 92 formed of elastic or elastomeric material having an outer diameter larger than an inner diameter of the constriction portion 11*e*, and a dipping tube 93 in which a tubular hard material is inserted. On top of the main body 92, a flange portion 92*a* which protrudes outwardly in radial direction is formed. A spherical portion 93*a* which protrudes outwardly in radial direction is formed on the lower part of the dipping tube 93. The spherical portion 93*a* is inserted into the main body 92 and connects the main body 92 with the dipping tube 93 hermetically. Further, also in the two-liquid discharge container 90, the inside of the dipping tube 93 will be filled with the content of the lower storage 15 once the valve is opened. Therefore, it is preferably to use a metal pipe or a synthetic resin pipe in which the metal pipe such as stainless steel pipe is provided on the inner surface.

The main body 92 of the partition wall member 91 is inserted in the container body 11 from the opening of the container body 11, and then inserted in the constriction portion 11*e*, where the flange portion 92*a* of the main body 92 is hooked to the constriction portion 11*e*. And the dipping tube 93 is inserted in the center hole of the main body 92, and the main body 92 is pushed outwardly by the spherical portion 93*a*. However, it may be inserted into the container body after the main body 92 and the dipping tube 93 is connected and the fixing method is not limited. The inner surface of the constriction portion 11*e* may be formed to be tube surface like that of FIG. 1. In this case also, the dipping tube and the partition wall member can be hermetically engaged by forming the partition wall member with the elastic material.

In either of embodiments, the constriction portion 11*e* is formed on the barrel portion of the container body 11. And the inner diameter of the constriction portion 11*e* is made to be substantially same as the inner diameter of the neck portion 11*c* or smaller (inner diameter of the constriction portion≤inner diameter of the neck portion 11*c*). Therefore, the partition wall member 20 which can be inserted from the neck portion, can be stably engaged with the upper step of the constriction portion 11*e*. However the inner diameter of the constriction portion may be configured to be larger than the inner diameter of the top neck portion 11*c* of the container body 11 (inner diameter of the constriction portion≥inner diameter of the neck portion 11*c*). For example, in the case where the partition wall member 91 which enlarges the main body 92 by inserting the spherical portion 93*a* of the dipping tube 93 into the center hole, the partition wall member may be assembled by inserting the partition wall member 91 in which the size of the partition wall member 91 is reduced, hooking the flange portion 92*a* of the main body 92 to the constriction portion 11*e* of the container body 11 after inserting, and inserting the spherical portion 93*a* into the main body 92. The spherical portion 93*a* widens the main body 92 by inserting and as a result the inside of the container body 11 is divided into two storages 14, 15.

The constriction portion 11*e* of the container body may be omitted if the partition wall member 20 can be stably fixed and can be inserted through the opening. For example, when the inner diameter of the neck portion is larger than the inner diameter of the barrel portion, the two or more storages can be formed by arranging the partition wall member having a leg portion which holds or supports the partition wall member in the middle of the barrel portion.

The container main bodies 11 of previous embodiments are made of synthetic resin formed by blow molding, therefore it can be manufactured cheap. However, it may be manufactured by injection molding and or it may be assembled with plural components made of other material such as metal, etc. In that case, the container body may be formed to be rigid and with higher strength than the container body of blow forming. Further, when the metal is used, the inner surface is preferably to be coated with the synthetic resin liner or synthetic resin coat.

Figure 11:
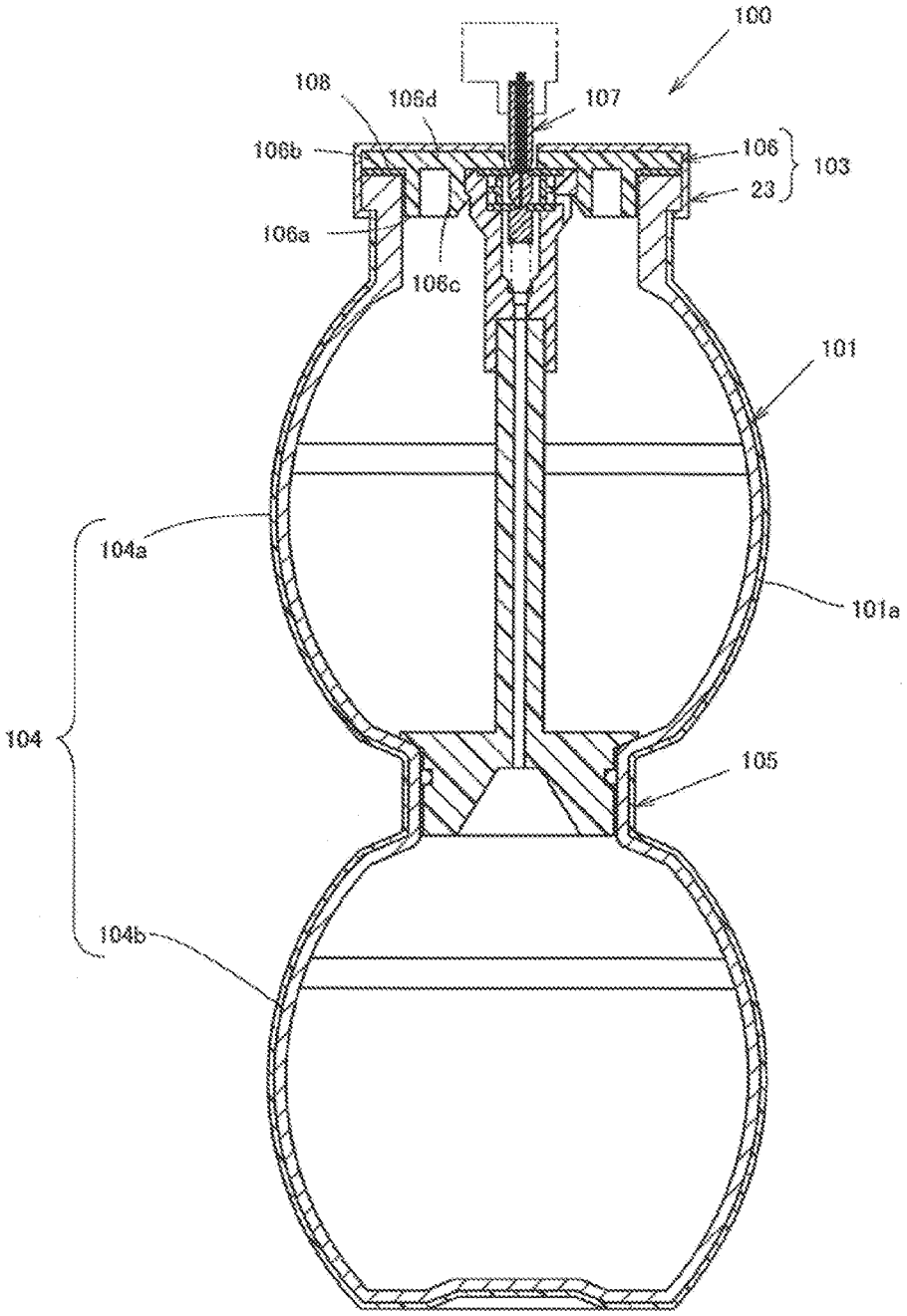
FIG. 11 is a cross sectional view showing the other embodiment of the two-liquid discharge container of the present invention.

The two-liquid discharge container 100 of FIG. 11 is equipped with a container body 101 made of glass. Specifically, it is an aerosol container equipped with the container body 101 made of glass, a partition wall member 12 dividing the inside space into one above the other, a valve assembly 103 closing the upper opening of the container body 101 and operating the opening and closing of the passage between the inner space and the outside. The partition wall member 12 is substantially same as the partition wall member 12 of FIG. 1, other than that the bottom of the partition wall portion 20 is positioned in inner tube surface of the constriction portion 105. Because the bottom of the partition wall portion 20 is in the inner tube surface, the content will not remains between the partition wall portion 20 and the container body 101, when used in inverted condition. This can also be said in the two-liquid discharge container 10 of FIG. 1, the two-liquid discharge container 38 of FIG. 2, and the two-liquid discharge container 52 of FIG. 5.

The container body 101 comprises a barrel portion, a shoulder portion, and a neck portion, where the neck portion has a flange portion, and where the barrel portion 104 has a tubular constriction portion 105 in between. It is pressure resistance container having a gourd-shaped. The constriction portion 105 vertically divides the barrel portion 104 into two in an upper barrel portion 104*a* and a lower barrel portion 104*b*. Both the upper barrel portion 104*a* and the lower barrel portion 104*b* are curved gradually protruding outside, therefore, the shape of the container body 101 is more closer to the gourd than the container body 11 of FIG. 1. By forming the upper barrel portion 104*a* and the lower barrel portion 104*b* closer to the globe, strength can be given against the external force. Especially, because it is made of glass, it is formed to be shatter proof.

Further, the synthetic resin coat 101*a* is provided on the outer surface. By providing the synthetic resin coat 101*a* on the outer surface, it lessen the impact to the container and prevents the broken pieces to spattered when crashed, therefore it is safe.

As for the glass, a silicate glass, a borate glass, and an acrylic glass may be applied. Further, a composite material in which the miniaturized glass is dispersed in the melted synthetic resin and formed may be used.

As for the synthetic resin coat 101*a*, a synthetic resin such as a polyvinyl chloride, polyethylene terephthalate, etc. may be cited. The synthetic resin coat may be formed by cooling the dipped glass container which is dipped in the melted synthetic resin. Further, to firmly attach the synthetic resin coat to the surface of the container body, it is preferable to provide a hole on the synthetic resin coat for vacuuming the air between the synthetic resin coat and the container body.

Because the container body 101 is made of glass, the influence from the content is small like the container body made of synthetic resin. This container is suitable for storing the first agent of the two-liquid type hair dye which change or resolve the property of the synthetic resin or for safely storing dimethyl ether used as liquefied gas. Further, it can store a gas which infiltrates the synthetic resins. As well, the container body 101 may be used as the container body of FIG. 2, 5, 7.

The valve assembly 103 is equipped with a valve holder 106 fixed to the opening of the container body 101, a valve mechanism 107 fixed to the center of the valve holder 107, and a mount cover 23 fixing the valve holder 106 to the container body 101. The mount cover 23 is substantially same as that of mount cover 23 of FIG. 1.

The valve holder 106 has an outer tube portion (cylindrical wall) 106*a* inserted into the neck portion of the container body 101, a flange 106*b* protruding outwardly from the top of the outer tube portion and which engages with the top of the flange of the container body 101, an inner tube portion 106*c* storing the valve mechanism 107 and having a ceiling, and a connecting portion 106*d* connecting the top of the outer tube portion 106*a* with the top of the inner tube portion 106*c*. Unlike the valve holder 21 of FIG. 1, the connecting portion 106*d* of the valve holder 106 is positioned on top of the outer tube portion 106*a* and on top of the inner tube portion 106*c*. Further, between the flange 106*b* of the valve holder 106 and the top of the neck portion of the container body 101, a ring shaped gasket is provided. The valve holder is formed of synthetic resin. The sealing structure between the container body 101 and the valve holder 106 may be formed by providing the O-ring between the outer tube portion 106*a* of the valve holder 106 and the inner surface of the neck portion of the container body 101 like the sealing structure of the two-liquid discharge container 54 of FIG. 6 and the two-liquid discharge container 58 of FIG. 7.

The valve mechanism 107 communicates the second stem hole (lower stem hole) with the center hole of the small diameter tube of stem 31 and communicates the first stem hole (upper stem hole) with the gap between the large diameter tube and the small diameter tube, like the valve mechanism 22 of the two-liquid discharge container of FIG. 9.

In this two-liquid discharge container 100, the first discharge passage and the second discharge passage are communicated with the gas phases of each storage, respectively, when in upstand state. Therefore, the contact of the first content and the second content can be prevented and both can be stored stably.

Figure 12:
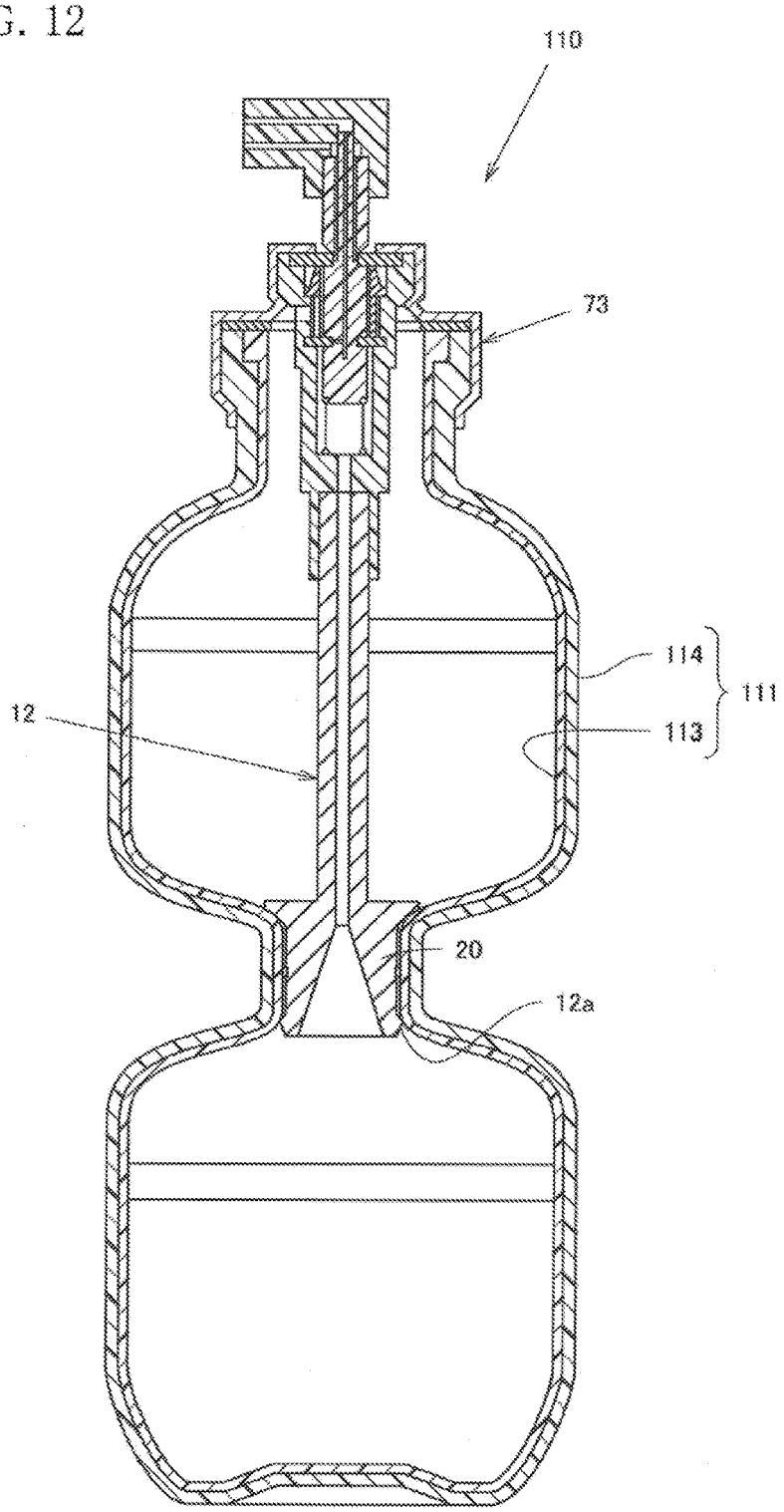
FIG. 12 is a cross sectional view showing the other embodiment of the two-liquid discharge container of the present invention.

The two-liquid discharge container 110 of FIG. 12 is for using in inverted state, and comprises a container body 111 having two-layer structure made of synthetic resin. Especially, it is an aerosol container which comprises the container body 111 having the constriction portion, the partition wall member 12 which vertically divides the inner space of the container body, and the valve assembly 74 which closes the upper opening of the container body 111 and which operates the opening and closing of the passage between the inner space and the outside. The partition wall member 12 is substantially same as the partition wall member 12 of FIG. 1 except for that the bottom of the partition wall portion 20 of the partition wall member 12 has a engaging protrusion 12*a* which clip on and engages with the inside wall of the lower storage 15. The valve assembly 73 is substantially same as the valve assembly 73 of FIG. 9 except for that it lacks the outside dipping tube.

The container body 111 is formed by closely attaching two containers (inner container 113, outer container 114). For example, it can be manufactured by forming an outer preform for outer container and an inner preform for inner container by injection molding, preparing two layer preform by inserting the inner preform in the outer preform, forming the outer container 114 and the inner container 113 simultaneously by biaxial stretching blow molding from the two layer preform. By this manufacturing method, the container body 111 having the outer surface of the inner container 113 closely attached to the inner surface of the outer container 114, can be manufactured. However, it can be prepared by forming the outer container 114, and inserting the inner container 113 by squashing or a synthetic resin coating can be applied to the inner surface of the outer container 114 as the inner container 113.

By having the container body 111 in two-layer structure, the durability of both the upper storage and the lower storage against the contents can be enhanced, and the strength can be enhanced. That is, the inner container 113 can be formed with the material durable against the content, and the outer container 114 can be formed with the material which is strong against the inner pressure. For example, in the case where the first agent of the hair dye including the oxidation dye is stored in the upper storage 14 and the second agent of the hair dye including the oxidant is stored in the lower storage 15. A material durable against both contents such as polyolefin including polypropylene, polyethylene, etc., polyamide including nylon, etc. can be cited as a material for the inner container. And a material having high strength and can reinforce the inner container such as polyester including polyethylene terephthalate, etc., can be cited as a material for the outer container.

The present invention of two-liquid discharge container stores two liquids and dispenses two liquids individually or after mixing. However, unless the effects are not interfered, it may be configured to have three liquids stored and dispensed. For example, three storages may be provided by positioning partition wall members in between each border, or inserting two or more pouch in the storage.

The invention claimed is:

1. A two-liquid discharge container, comprising:

a container body made of non-metal material having an opening defined in the container body, a partition wall member vertically dividing an interior of the container body into a plurality of storages, and a valve having a discharge passage communicating the plurality of storages with outside of the container body, wherein the container body has a constriction portion between the plurality of storages, the constriction portion being radially contracted, wherein the inner diameter of the constriction portion is substantially the same as or smaller than the inner diameter of the opening of the container body, wherein an inner surface of the constriction portion is a smooth tube face, wherein the inner diameter of the constriction portion is substantially the same as or smaller than the inner diameter of the opening of the container body, such that after the container body is formed, the partition wall member is inserted through the opening of the container body and fitted in place to partition the container body into the plurality of storages, wherein contents that react with each other by mixing are charged in each storage of the plurality of storages, wherein at least the contents of a lower storage of the plurality of storages contains a liquefied gas, wherein a gas phase of the liquefied gas lies directly below the partition wall member between the content charged in the lower storage and the partition wall member, wherein the discharge passage is composed of a first discharge passage communicating an upper storage of the plurality of storages with outside of the container, and a second discharge passage communicating the lower storage with the outside of the container, wherein, in a stand-up condition, the second discharge passage communicates with the gas phase in the lower storage, and in an inverted condition, the second discharge passage communicates with a liquid phase in the lower storage.

2. A two-liquid discharge container according to claim 1, wherein the container body is made of synthetic resin.

3. A two-liquid discharge container according to claim 1, wherein the container body is made of glass.

4. A two-liquid discharge container according to claim 1, wherein a pouch is housed in the upper storage, and wherein a concentrate of the content is charged in the pouch and a propellant of the content is charged in the upper storage of the plurality of storages outside of the pouch.

5. A two-liquid discharge container according to claim 1, wherein, in an stand-up condition, the first discharge passage and the second discharge passage communicates with a gas phase in the respective storages, and in an inverted condition, the first discharge passage and the second discharge passage communicates with a liquid phase in respective ones of the plurality of storages.

6. A two-liquid discharge container according to claim 1, further comprising a first tube passage communicating the upper storage with the valve and a second tube passage communicating the lower storage with the valve, wherein the first tube passage and the second tube passage are arranged concentrically.

7. A two-liquid discharge container according to claim 1, wherein the partition wall member has a partition wall portion having a column-shape which fits with the inner surface of the constriction portion, and wherein a circular groove is defined in an outer surface of the partition wall portion and an O-ring is fixed to the circular groove.

* * * * *